US008185012B2

(12) United States Patent
Wakayama

(10) Patent No.: US 8,185,012 B2
(45) Date of Patent: May 22, 2012

(54) DEVELOPER STORAGE CONTAINER AND IMAGE FORMING APPARATUS PROVIDED THEREWITH

(75) Inventor: Kei Wakayama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 362 days.

(21) Appl. No.: 12/538,425

(22) Filed: Aug. 10, 2009

(65) Prior Publication Data

US 2010/0080607 A1 Apr. 1, 2010

(30) Foreign Application Priority Data

Sep. 29, 2008 (JP) ..... 2008-251098

(51) Int. Cl.
*G03G 15/08* (2006.01)

(52) U.S. Cl. ..... 399/105

(58) Field of Classification Search ..... 399/103, 399/105, 106, 113, 262, 119; 222/542, DIG. 1
See application file for complete search history.

(56) References Cited

U.S. PATENT DOCUMENTS

| | | | | |
|---|---|---|---|---|
| 5,426,493 | A * | 6/1995 | Oyler | 399/262 |
| 5,594,535 | A * | 1/1997 | Beaufort et al. | 399/262 |
| 5,740,499 | A * | 4/1998 | Higeta et al. | 399/105 |
| 6,993,265 | B2 * | 1/2006 | Morgan | 399/106 |
| 7,590,369 | B2 * | 9/2009 | Wazana et al. | 399/109 |
| 7,974,551 | B2 * | 7/2011 | Nishimura | 399/113 |

FOREIGN PATENT DOCUMENTS

| | | | |
|---|---|---|---|
| JP | 08179613 | A * | 7/1996 |
| JP | 2000-238864 | | 9/2000 |
| JP | 2001117342 | A * | 4/2001 |
| JP | 2006126704 | A * | 5/2006 |

* cited by examiner

*Primary Examiner* — Robert Beauty
(74) *Attorney, Agent, or Firm* — Smith, Gambrell & Russell, LLP

(57) ABSTRACT

To a lower part of a housing 20 of a development unit 3*a*, a cover 21 is detachably fitted by using snap fittings 40. To a fitting surface 41*a* of the housing 20 and a fitting surface 41*b* of the cover 21, sponges 43*a* and 43*b*, respectively, are attached and fixed all around them. In a state in which the snap fittings 40 are engaged and thereby the housing 20 and the cover 21 are fixed to each other, the sponges 43*a* and 43*b* are in contact with each other and compressed, whereby air-tightness of a fitting part 45 is secured.

6 Claims, 6 Drawing Sheets

DEVELOPER STORAGE CONTAINER AND IMAGE FORMING APPARATUS PROVIDED THEREWITH

This application is based on Japanese Patent Application No. 2008-251098 filed on Sep. 29, 2008, the contents of which are hereby incorporated by reference.

BACKGROUND OF THE INVENTION

1. Field of the Invention

The present invention relates to a developer storage container such as a development device, a toner container, and a toner cartridge incorporated in an image forming apparatus such as a copier, a facsimile, and a printer. In particular, the present invention relates to a method for preventing developer leakage from inside a container.

2. Description of Related Art

In image forming apparatuses such as copiers, printers, and facsimiles using electrophotography method, powder developers are mainly used, and the following image forming process is typically performed therein; an electrostatic latent image formed on an image carrier such as a photoconductor drum by using a development device is visualized, the visualized image is transferred onto a recording medium, and then fixing is performed.

A casing of such a development device is typically composed of: a housing (container main body) that has an agitation-conveyance member, a developer carrier, and the like arranged therein and in which a developer is stored; and a cover (lid body) that closes an opening of the container main body. An elastic member made of sponge, rubber, or the like is attached to a fitting surface of either the housing or the cover, and the elastic member is compressed between the fitting surfaces when the housing and the cover are fitted together, whereby air-tightness of the development device is secured.

In the above structure, however, the part that comes in contact with the top end part of the elastic member is formed of a resin of which the housing and the cover are formed. As a result, particularly in a case in which a housing and a cover are fitted to each other by a snap fitting, vibration or shock applied from outside is liable to cause a gap or displacement between the elastic member and the resin member that is in contact with the elastic member, and this may invite developer leakage.

To cope with this inconvenience, there have been proposed methods of preventing powder from leaking out of a powder charge container that is divided into at least two parts. For example, JP-A-2000-238864 discloses a powder charge container in which elastic particles are adhered to fitting surfaces of a plurality of parts of a container, and the fitting surfaces are detachably fitted to each other by being pressed against each other.

In a case of fitting by using a snap fitting, predetermined clearance (extra space) is provided in a fitting part to improve the workability in fitting and detaching a cover to and from a housing. Thus, it is necessary to adjust the cushioning characteristic and the thickness of an elastic member attached to the fitting part to be within a preferable range. For example, too weak cushioning characteristic (elasticity) or too small thickness of the elastic member reduces adaptability of the elastic member with respect to displacement occurring at the fitting part. As a result, a gap is liable to be formed. If the elastic member is too thick, its elasticity is liable to cause deformation of a resin member.

However, with the method disclosed in JP-A-2000-238864, in which only one layer of elastic particles is adhered to each of the fitting surfaces, the thickness of the elastic layer needs to be adjusted by using elastic particles having a different diameter or by changing a number of times of repetition of adhesive layer application and elastic-particle attachment to the adhesive layer. This disadvantageously lowers manufacturing efficiency. In addition, JP-A-2000-238864 describes, as a method of fitting the container parts to each other by applying pressure, only a method of fitting them to each other by using a screw member; no description is given with respect to the above mentioned relationship between a snap fitting and the cushioning characteristic and the thickness of an elastic member.

Incidentally, although the above description deals with developer leakage from the casing of a development device, the casing of a toner container or of a toner cartridge supplying a developer (toner) to a development device suffers from the same inconvenience.

SUMMARY OF THE INVENTION

In view of the above problems, an object of the present invention is to provide a developer storage container capable of preventing, with a simple structure, developer leakage through a gap between a housing and a cover fitted to each other by a snap fitting, and an image forming apparatus provided therewith.

To achieve the above object, according to one aspect of the present invention, a developer storage container includes: a first frame body for storing a developer; a second frame body that is fitted to the first frame body; fitting means having a locking portion formed in one of the first and second frame bodies and a locked portion formed in an other of the first and second frame bodies. Here, an elastic member is attached to a fitting surface of each of the first and second frame bodies all around the fitting surface, is compressed by a predetermined amount when the first and second frame bodies are in a fitting state in which they are fitted to each together by the fitting means.

With this structure, at fitting surfaces of the first and second frame bodies, elastic members attached to the fitting surfaces are pressed against each other, and thus friction resistance at the fitting surfaces is higher than in a conventional structure in which an elastic member and a frame body are pressed against each other. This gives the elastic members a significantly improved adaptability with respect to displacement. In addition, forming the elastic members to be substantially rectangular in section allows them to contact each other over a larger area. This reduces the likelihood of a gap formed between the first and second frame bodies when a shock is applied to the developer storage container, and thus developer leakage from a fitting part can be effectively prevented.

According to the present invention, in the above-structured developer storage container, it is preferable that the elastic member be a sponge, and that the fitting means be a snap fitting comprising a bridge formed in one of the first and second frame bodies and a projection formed in an other of the first and second frame bodies, at least one of the bridge and the projection being elastically deformed to achieve engagement between the bridge and the projection.

With this structure, the first and second frame bodies can be easily detached from each other, and this facilitates replacement and maintenance of components inside the frame bodies. In addition, use of a sponge, whose friction coefficient is large, as an elastic member prevents a gap from being formed between the first and second frame bodies, and thus helps effectively prevent developer leakage from the fitting part.

According to the present invention, in the above-structured developer storage container, it is preferable that the sponge be substantially rectangular in section.

With this structure, a contact area between sponges is enlarged, and thus the fitting part can be sealed more effectively.

According to the present invention, in the above-structured developer storage container, it is preferable that a compression amount of the sponge be 70% of an initial thickness of the sponge.

With this structure, the compression amount of the sponge can be an appropriate compression amount that neither allows a gap to be formed between the first and second frame bodies nor allows restoring force of the sponge to cause deformation in the fitting part.

According to another aspect of the present invention, a developer storage container includes: a housing for storing a developer; a cover for closing an opening of the housing; a snap fitting comprising a projection formed in one of the housing and the cover and a bridge formed in an other of the housing and the cover, the projection and the bridge being elastically deformed into engagement with each other so as to maintain the housing and the cover in a fitting state in which the housing and the cover are fitted together; and sponge that are attached one to a fitting surface of each of the housing and the cover all around the fitting surface, and a sum of thicknesses of which exceeds clearance in the snap fitting.

With this structure, in comparison with the conventional structure in which a sponge is attached to only one of the fitting surfaces, the sponges exert significantly improved adaptability with respect to displacement of the fitting surfaces. This reduces the likelihood of a gap being formed between the first and second frame bodies when a shock is applied to the developer storage container, and thus developer leakage from the fitting part can be effectively prevented.

According to another aspect of the present invention, an image forming apparatus is provided with the developer storage container having any one of the above structures.

With this structure, it is possible to effectively prevent an inside of the image forming apparatus from being stained due to developer leakage from the developer storage container.

DETAILED DESCRIPTION OF PREFERRED EMBODIMENTS

Figure 1:
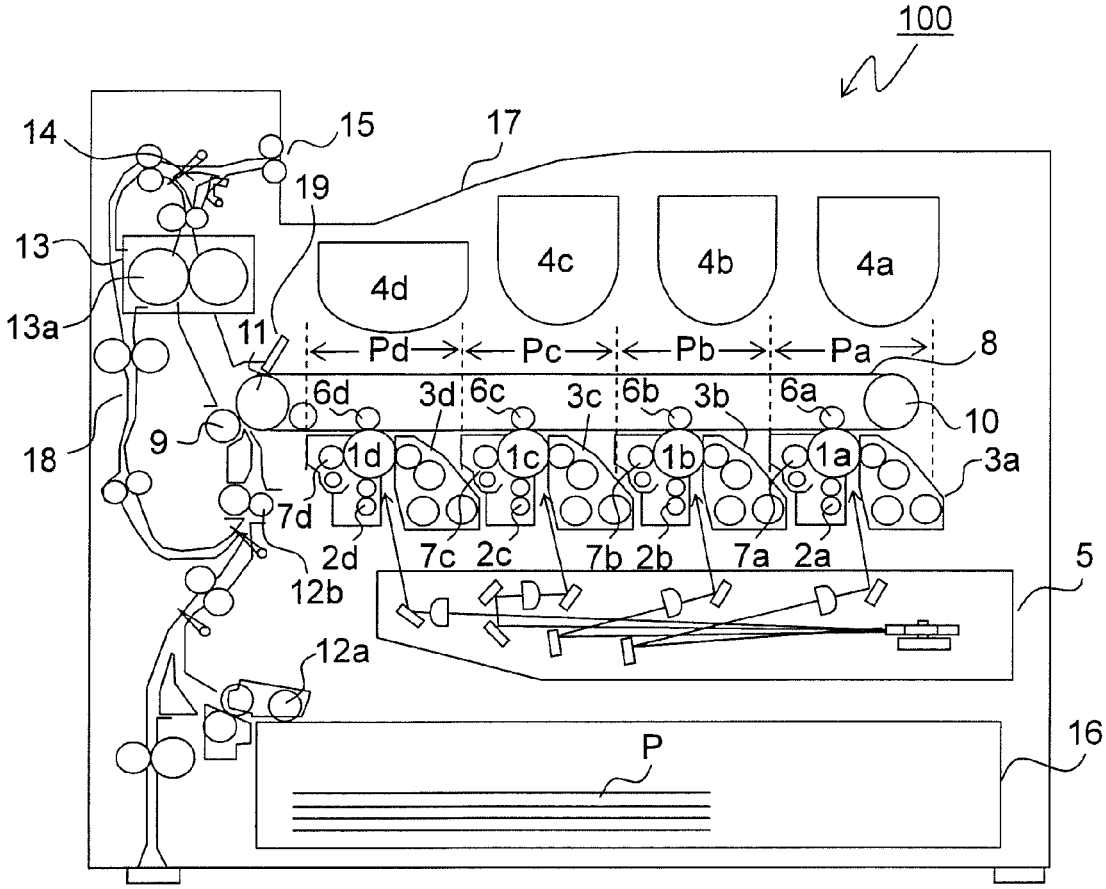
FIG. 1 is a diagram schematically showing the overall structure of an image forming apparatus incorporating a development unit of the present invention.

Hereinafter, embodiments of the invention will be described with reference to the drawings. FIG. 1 is a sectional view schematically showing an image forming apparatus incorporating a development unit of the present invention, and here a tandem-type color image forming apparatus is illustrated. Inside the main body of an image forming apparatus 100, four image forming sections Pa, Pb, Pc, and Pd are disposed sequentially from the upstream side (in FIG. 1, the right side) in a transfer direction. These image forming sections Pa to Pd are respectively disposed for forming images of four different colors (cyan, magenta, yellow, and black), and each of them sequentially forms a cyan, magenta, a yellow, and a black image through each process of charge, exposure, development, and transfer.

In the image forming sections Pa to Pd, photoconductor drums 1*a*, 1*b*, 1*c*, and 1*d* are disposed to each carry a visible image (toner image) of a corresponding color. Furthermore, an intermediate transfer belt 8 that is rotated clockwise in FIG. 1 by a drive means (not shown) is provided adjacent to the image forming sections Pa to Pd. After the toner images respectively formed on the photoconductor drums 1*a* to 1*d* are sequentially transferred onto the intermediate transfer belt 8 that rotationally moves in contact with each of the photoconductor drums 1*a* to 1*d*, the images are transferred onto transfer paper P all at once at a secondary transfer roller 9, and fixed on the transfer paper P at a fixing section 7, and then the transfer paper P is ejected from the apparatus main body. While the photoconductor drums 1*a* to 1*d* are turning counterclockwise in FIG. 1, image forming processes are respectively carried out with respect to each of the photoconductor drums 1*a* to 1*d*.

The transfer paper P onto which the toner images are to be transferred is stored in a paper cassette 16 provided at a lower part of the apparatus, and is conveyed to a secondary transfer roller 9 via a paper feeding roller 12*a* and a pair of registration rollers 12*b*. The intermediate transfer belt 8 may be made by forming a dielectric resin sheet into an endless-shaped belt by overlapping and butting both ends of the dielectric resin sheet or into a belt without a seam (seamless belt). Also, on the downstream side of the secondary transfer roller 9, a blade-shaped belt cleaner 19 is disposed for the purpose of removing toner remaining on the surface of the intermediate transfer belt 8.

Next, the image forming sections Pa to Pd will be described. Disposed around and below the rotatably arranged photoconductor drums 1*a* to 1*d* are: chargers 2*a*, 2*b*, 2*c*, and 2*d* for charging the photoconductor drums 1*a* to 1*d*; an exposure unit 5 for exposing image data onto the photoconductor drums 1*a* to 1*d*; development units 3*a*, 3*b*, 3*c*, and 3*d* for forming toner images on the photoconductor drums 1*a* to 1*d*; and cleaning sections 7*a*, 7*b*, 7*c*, and 7*d* for removing developer (toner) remaining on the photoconductor drums 1*a* to 1*d*.

When a user inputs a command to start image forming, first, the surfaces of the photoconductor drums 1*a* to 1*d* are uniformly charged by the chargers 2*a* to 2*d*, and then the photoconductor drums 1*a* to 1*d* are irradiated with light by the exposure unit 5, whereby electrostatic latent images are formed on the photoconductor drums 1*a* to 1*d* according to an image signal. The development units 3*a* to 3*d* are respectively charged with predetermined amounts of cyan, magenta, yellow, and black toners by the toner containers 4*a* to 4*d*. These toners are supplied from the development units 3*a* to 3*d* onto the photoconductor drums 1*a* to 1*d*, and attaches to the electrostatic latent images formed through exposure from the exposure unit 5, whereby toner images are formed according to the electrostatic latent images.

Then, a predetermined voltage is applied to primary transfer rollers 6*a* to 6*d*, and thereby the cyan, magenta, yellow, and black toner images formed on the photoconductor drums 1*a* to 1*d* are transferred onto the intermediate transfer belt 8. These images of the four colors are formed in a predetermined positional relation for formation of a predetermined full color image. Thereafter, toner remaining on the surface of photoconductor drums 1*a* to 1*d* is removed by the cleaning sections 7*a* to 7*d* in preparation for another subsequent electrostatic latent image formation.

The transfer belt 8 is supported by a conveyance roller 10 on the upstream side and a drive roller 11 on the downstream side. When the transfer belt 8 starts rotating clockwise with the rotation of the drive roller 11 caused by a drive motor (not shown), the transfer paper P is conveyed at a predetermined timing through the pair of registration rollers 12*b* to the secondary transfer roller 9 provided adjacent to the intermediate transfer belt 8, where a full-color image is transferred onto the transfer paper P. The transfer paper P onto which the toner image has been transferred is then conveyed to a fixing section 13.

At the fixing section 13, heat and pressure is applied to the transfer paper P by a pair of fixing rollers 13*a* to fix the toner image on the surface of the paper P, whereby a predetermined full-color image is formed. Then, the transfer paper P on which the full-color image has been formed is conveyed to a branch section 14 that is branched into a plurality of directions, where a conveyance direction of the paper P is determined by the branch section 14. In a case of forming an image only on one surface of the transfer paper P, the transfer paper P is directly ejected onto a paper ejection tray 17 by an ejection roller 15.

On the other hand, in a case of forming images on both surfaces of the transfer paper P, at the branch section 14, the transfer paper P having passed through the fixing section 13 is lead to a paper conveyance passage 18, and is conveyed back to the secondary transfer roller 9 upside down, that is, with the surface of the transfer paper P on which an image has been formed facing an opposite direction. Then, a next image formed on the intermediate transfer belt 8 is transferred by the secondary transfer roller 9 onto a surface of the transfer paper P on which no image is formed, the transfer paper P is then conveyed to the fixing section 13, where the toner image is fixed thereon, and then the transfer paper P is ejected onto the paper ejection tray 17.

Figure 2:
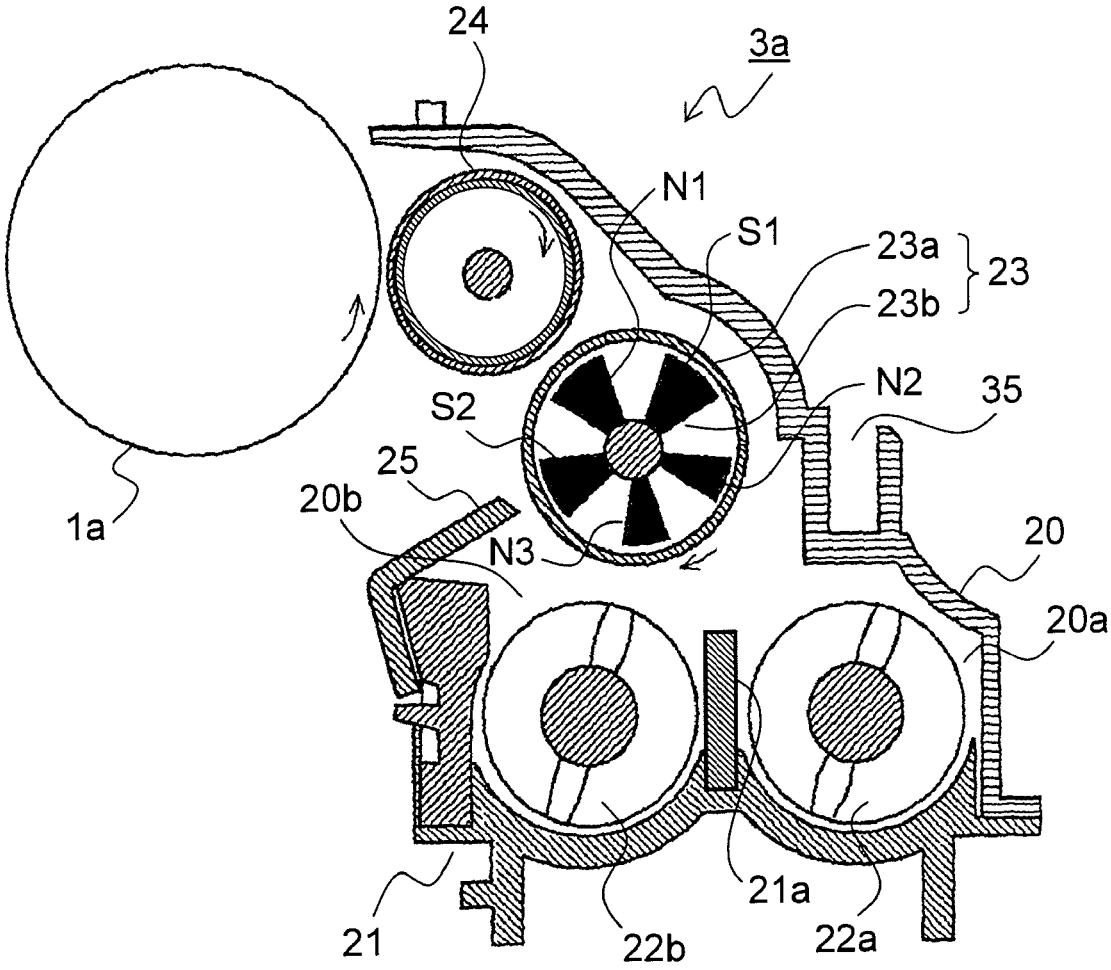
FIG. 2 is a side sectional view showing the development unit of the present invention.

FIG. 2 is a side sectional view showing the structure of a development unit of the present invention. Here, a description will be given of the development unit 3*a* disposed in the image forming section Pa shown in FIG. 1, and, since the development units 3*b* to 3*d* disposed in the image forming sections Pb to Pd have a structure basically similar to that of the development unit 3*a*, descriptions thereof will be omitted.

As shown in FIG. 2, the development unit 3*a* is provided with a housing (first frame body) 20 in which a two-component developer (hereinafter, simply referred to as developer) is stored. To a bottom portion of the housing 20 is fitted a cover (second frame body) 21 that forms part of first and second agitation chambers 20*a* and 20*b*. Inside the cover 21, a dividing wall 21*a* is provided in a standing state, and the housing 20 is divided into the first and second agitation chambers 20*a* and 20*b* by the dividing wall 21*a*. A first agitation screw 22*a* and a second agitation screw 22*b* are rotatably disposed in the first and second agitation chambers 20*a* and 20*b*, respectively, for mixing, with a carrier, toner (positively-charged toner) supplied from the toner container 4*a* (see FIG. 1), agitating the mixture, and charging the toner.

The developer is agitated by the first and second agitation screws 22*a* and 22*b* so as to be conveyed in an axial direction, and circulates between the first and second agitation chambers 20*a* and 20*b* through a developer passage (not shown) formed in the dividing wall 21*a*. In the illustrated example, the development unit 3*a* extends in an obliquely upward to the left; inside the housing 20, a magnetic roller 23 is disposed above the second agitation screw 22*b*; and a development roller 24 is disposed obliquely upward to the left from the magnetic roller 23 such that the development roller 24 is disposed opposite the magnetic roller 23. The development roller 24 is disposed opposite the photoconductor drum 1*a* on the opening side (on the left side in FIG. 2) of the housing 20; the magnetic roller 23 and the development roller 24 rotate in the clockwise direction as seen in the figure.

On an inside surface of the cover 21, a toner sensor 27 (see FIG. 4) is disposed, and toner is supplied from the toner container 4*a* (see FIG. 1) into the housing 20 through a toner supply inlet 35 according to toner concentration detected by the toner sensor 27.

The magnetic roller 23 is composed of a non-magnetic rotation sleeve 23*a* and a fixed magnet roller member 23*b* having a plurality of magnetic poles contained inside the rotation sleeve 23*a*. In the illustrated example, the fixed magnet roller member 23*b* has five magnetic poles of 3 N poles (poles N1 to N3) and two S poles (poles S1 and S2), and in a rotation direction of the rotation sleeve 23*a*, the pole S1 is disposed between the poles N1 and N2, and the pole S2 is disposed between the poles N3 and N1.

The development roller 24 is formed with a non-magnetic rotation sleeve. The rotation sleeve 23*a* of the magnetic roller 23 and the development roller 24 are located opposite each other with a predetermined gap left therebetween at a facing (opposite) position. That is, the development roller 24 faces the pole N1 with a predetermined gap therebetween.

An ear cutting blade 25 is attached to the housing 20 along a longitudinal direction (a front-to-rear direction of the plane of FIG. 2) of the rotation sleeve 23*a*. The ear cutting blade 25 is disposed upstream side of a position at which the development roller 24 and the magnetic roller 23 face each other, as seen in the direction of rotation of the rotation sleeve 23*a* (in the clockwise direction as seen in the figure). A narrow space (gap) is provided between an edge of the ear cutting blade 25 and the surface of the rotation sleeve 23*a*.

To each of the magnetic roller 23 and the development roller 24, a predetermined direct-current voltage and a predetermined alternate-current voltage are applied. As already described, the developer is agitated and circulated inside the housing 20 by the first and second agitation screws 22*a* and 22*b* to charge toner, and is conveyed to the magnetic roller 23 by the second agitation screw 22*b*. A magnetic brush (not shown) is then formed on the magnetic roller 23. The thickness of the layer of the magnetic brush is regulated by the ear cutting blade 25, and a thin toner layer is formed on the development roller 24 by using a potential difference between the magnetic roller 23 and the development roller 24 and a magnetic field between the pole N1 and the development roller 24. An electrostatic latent image on the photoconductor drum 1 is then developed by this thin toner layer formed on the development roller 24.

With reference to FIG. 2, a description will be given of how an amount of toner on the magnetic roller 23 is regulated. As shown in FIG. 2, the pole S2 (ear cutting pole) is disposed opposite the ear cutting blade 25, and thus, use of a non-magnetic or a magnetic member as the ear cutting blade 25 allows a magnetic field to be generated extending in the gap between the edge of the ear cut blade 25 and the rotation sleeve 23*a*.

By this magnetic field, a so-called magnetic brush is formed in which toner and carrier are erected into a brush-like shape between the ear cutting blade 25 and the rotation sleeve 23*a*. Then, when the rotation sleeve 23*a* rotates clockwise so that the magnetic brush moves to a position where it faces the development roller 24, the magnetic brush touches the surface of the development roller 24 to form a thin toner layer thereon.

When the rotation sleeve 23*a* further rotates clockwise, the magnetic brush is now moved away from the surface of the development roller 24 by a magnetic field in a horizontal direction (roller circumferential direction) generated between the poles N1 and S1, and toner remaining on the surface of the development roller 24 without being used for toner image formation is collected from the surface of the development roller 24 onto the rotation sleeve 23*a*. When the rotation sleeve 23*a* further rotates, a repulsing magnetic field is applied by the poles N2 and N3, and thus the toner and the carrier fall off the rotation sleeve 23*a* in the housing 20. Then, after being agitated and conveyed by the second agitation screw 22*b*, the toner and the carrier are again formed into a magnetic brush on the rotation sleeve 23*a* by the magnetic field of the pole S2. That is, the amount of toner to be attached to the magnetic roller 23*a* is strictly controlled not only by the distance between the ear cutting blade 25 and the rotation sleeve 23*a* but also by magnetic fields generated between the rotation sleeve 23*a* and the ear cutting blade 25.

Figure 3:
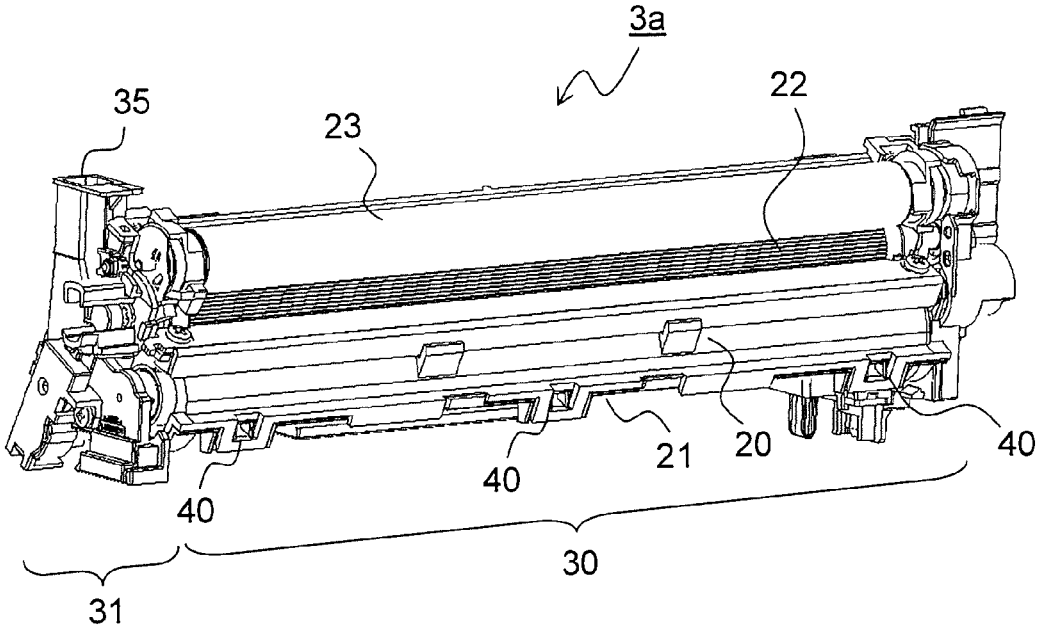
FIG. 3 is an external perspective view showing the development unit of the present invention as seen from a front surface side.
Figure 4:
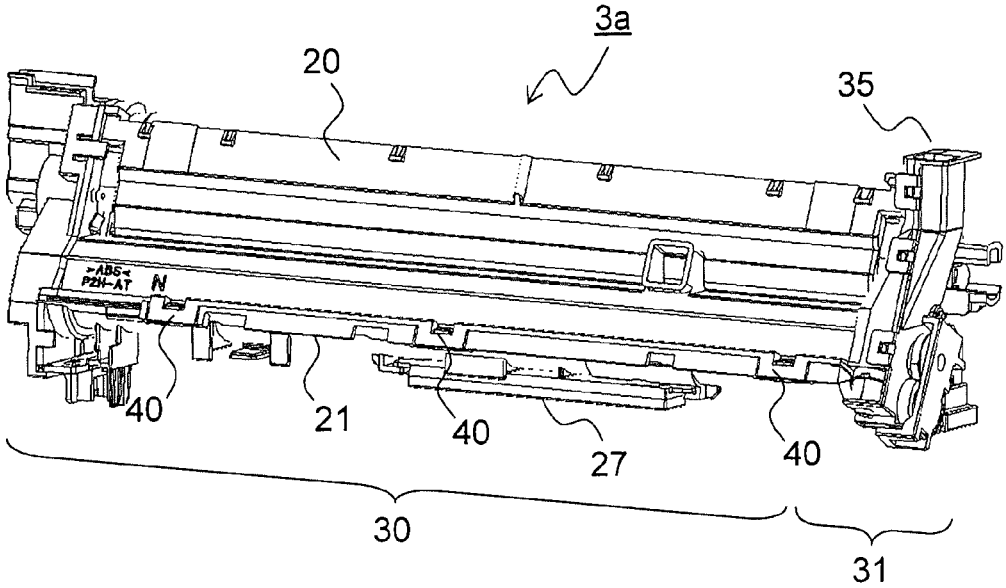
FIG. 4 is an external perspective view showing the development unit of the present invention as seen from a rear surface side.

FIGS. 3 and 4 are external perspective views showing the developing unit as seen from the front surface side (left side in FIG. 2) and the rear surface side, respectively, of the development unit. A toner storage section 31 for temporarily storing toner supplied from the toner container 4*a* (see FIG. 1) is provided at one end (left end in FIG. 3) of the development unit 3*a*. A development section 30 provided with the magnetic roller 23 and the development roller 24 is so provided adjacent to the toner storage section 31 as to extend in a lateral direction from the toner storage section 31. The toner storage section 31 is provided with the toner supply inlet 35 through which toner is received from the toner container 4*a*.

Toner supplied from the toner container 4*a* to the toner storage section 31 temporarily stays in the toner storage section 31, and is then conveyed from the toner storage section 31 by the first agitation screw 22*a* (see FIG. 2) extending to the toner storage section 31 to be supplied to the development section 30. To the lower part of the housing 20, the cover 21 is detachably fitted by snap fittings 40. The cover 21 can be detached from the housing 20 for the purpose of replacement or maintenance of the first and second agitation screws 22*a*, 22*b* (see FIG. 2), the magnetic roller 23, and the like disposed inside the housing 20.

Figure 5:
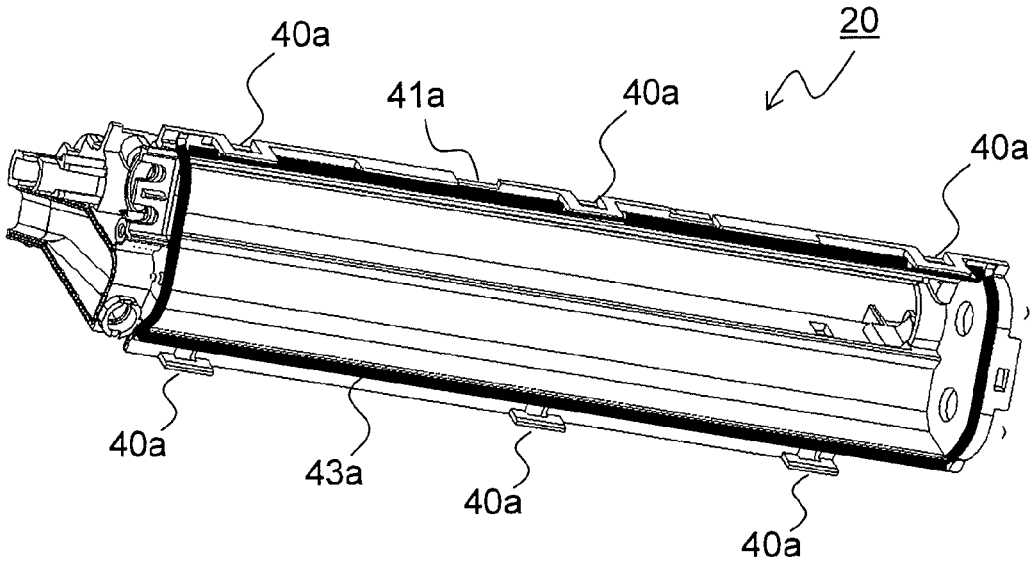
FIG. 5 is perspective view showing a housing of the development unit as seen from below.
Figure 6:
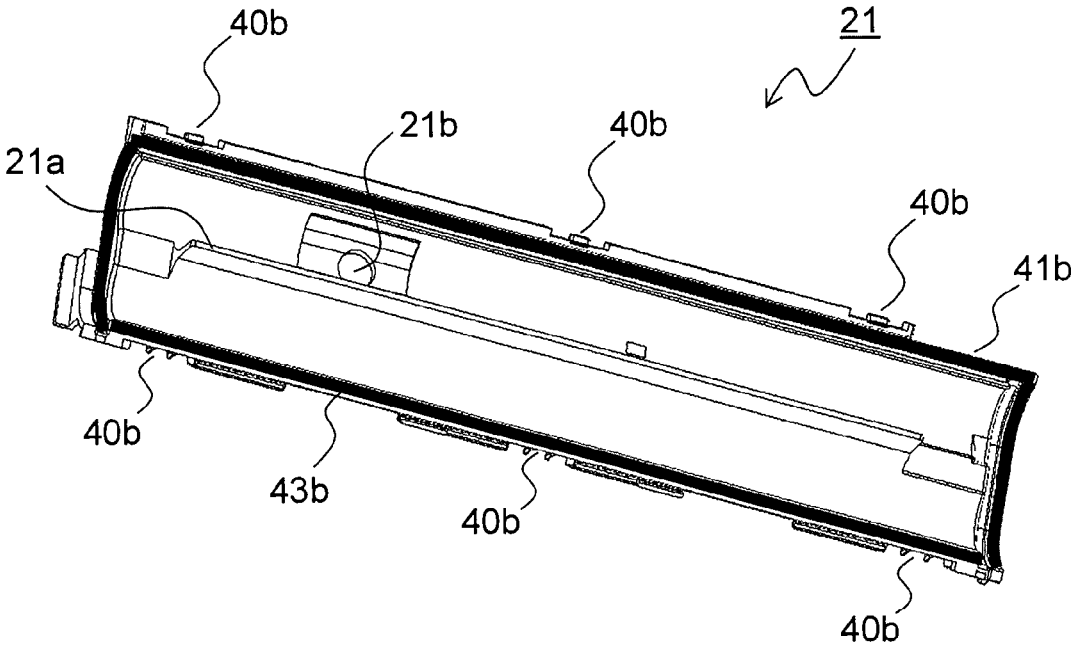
FIG. 6 is a perspective view showing an internal surface side of a cover of the development unit.

FIG. 5 is a perspective view showing the housing 20 as seen from below, and FIG. 6 is a perspective view showing an internal surface side of the cover 21. As shown in FIGS. 5 and 6, sponges 43*a* and 43*b* that are rectangular in section (indicated by thick black solid lines in the figures) are attached and firmly fixed to a fitting surface 41*a* of the housing 20 and a fitting surface 41*b* of the cover 21, respectively, all around the fitting surfaces 41*a* and 41*b*. Along two opposing outer edges of the fitting surface 41*a*, a total of six bridges 40*a* of the snap fittings 40 are formed three along each of the opposing outer edges. Along two opposing outer edges of the fitting surface 41*b*, projections 40*b* of the snap fittings 40 are provided at positions corresponding to the bridges 40*a*. In the internal surface of the cover 21, the dividing wall 21*a* and a sensor hole 21*b* for attaching the toner sensor 27 (see FIG. 4) are formed.

Figure 7:
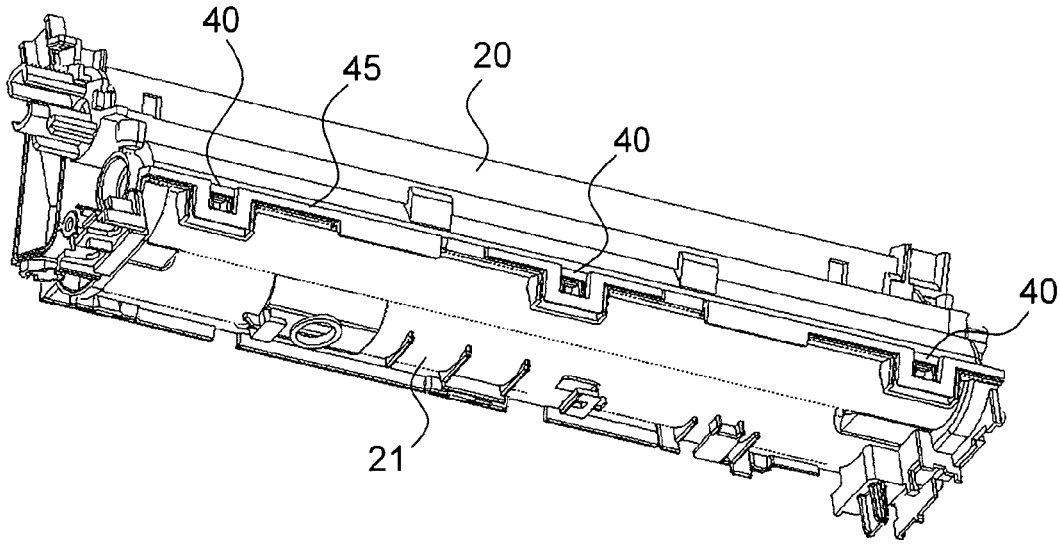
FIG. 7 is a perspective view showing the housing and the cover in a state in which the cover is fitted to the housing, as seen from a front surface side.
Figure 8:
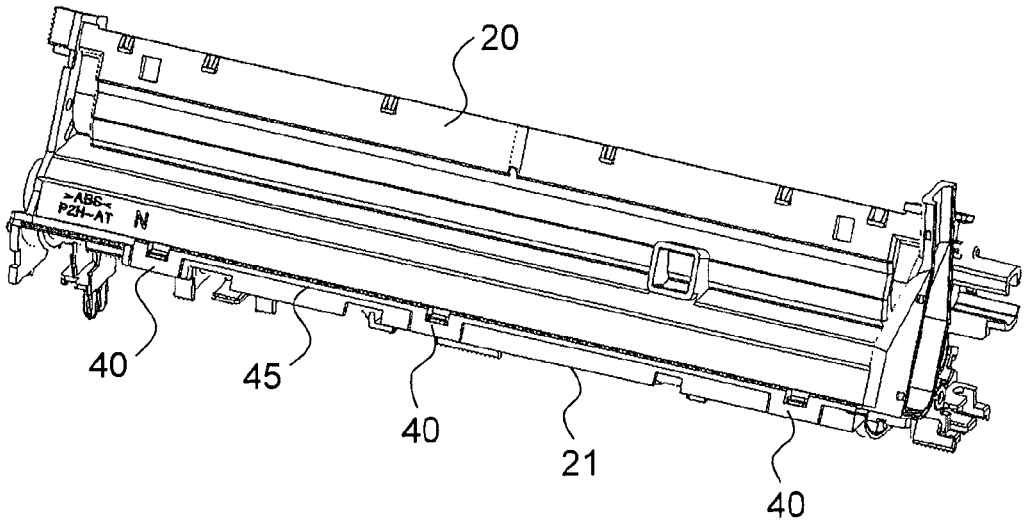
FIG. 8 is a perspective view showing the housing and the cover in a state in which the cover is fitted to the housing, as seen from a rear surface side.

FIGS. 7 and 8 are perspective views showing the housing 20 and the cover 21 in a state in which the cover 21 is fitted to the housing 20, as seen from a front surface side (FIG. 3 side) and as seen from a rear surface side, respectively. By adjusting the fitting surfaces 41*a* of the housing 20 and 41*b* of the cover 21 to a fitting position and pressing them against each other by engaging the snap fittings 40 at three positions on one side, three bridges 40*a* on the other side are elastically deformed to ride on the corresponding projections 40*b*, and as shown in FIGS. 7 and 8, the snap fittings 40 are brought into an engaged state, whereby the housing 20 and the cover 21 are fixed together. In this state, the sponges 43*a* and 43*b* are compressed, and thereby air-tightness of a fitting part 45 is secured.

In fixing the housing 20 and the cover 21 together by using the snap fittings 40, in view of handleability of the snap fittings 40, predetermined clearance (extra space) is provided in the engagement between bridges 40*a* and projections 40*b*. As a result, if a shock is applied to the housing 20, displacement may occur at the fitting part 45. To prevent this, according to the present invention, the sponges 43*a* and 43*b* are attached to the fitting surfaces 41*a* and 41*b* of the housing 20 and the cover 21, respectively, such that the sponges 43*a* and 43*b* contact each other.

Figure 9A:
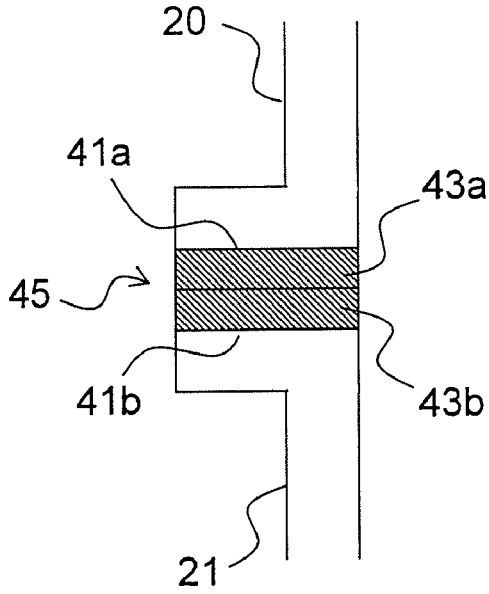
FIG. 9A is a sectional view schematically showing a fitting part of the housing and the cover.
Figure 9B:
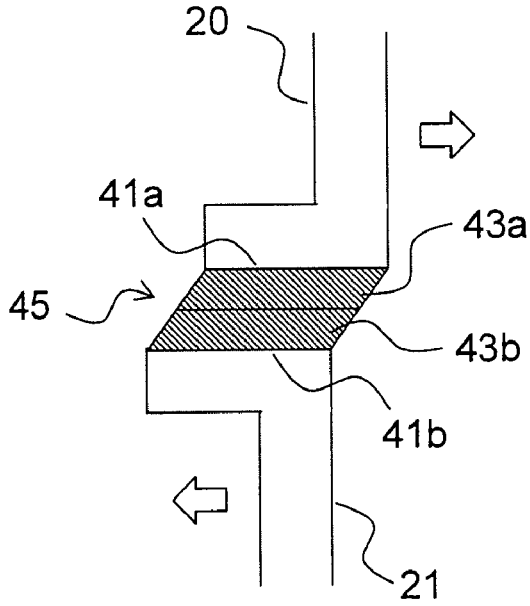
FIG. 9B is a sectional view schematically showing the fitting part of the housing and the cover in a state in which they are displaced from each other in the horizontal direction (the direction indicated by an arrow).

FIG. 9 is a sectional view schematically showing the fitting part 45 of the housing 20 and the cover 21. FIG. 9A shows the fitting part 45 in a normal position, and FIG. 9B shows the fitting part 45 in a state in which it is displaced in a horizontal direction (a direction indicated by an arrow). Since sponge-to-sponge friction coefficient is higher than sponge-to-resin friction coefficient, in comparison with a conventional structure in which sponge is attached only to one fitting surface, as shown in FIG. 9B, adaptability of the sponges 43*a* and 43*b* with respect to displacement of the fitting surfaces 41*a* and 41*b* is significantly improved. This reduces the likelihood of a gap being formed between the housing 20 and the cover 21 even if a shock is applied to the housing 20, and thus development leakage from the fitting part 45 is effectively prevented.

In addition, since the sponges 43*a* and 43*b* are substantially rectangular in section, a contact area over which the sponges 43*a* and 43*b* contact each other becomes large, and thus the fitting part 45 can be sealed more effectively. Examples of a sponge include one produced by foam molding a synthetic resin such as polyurethane and a rubber sponge produced by kneading rubber with a foaming agent, a softening agent, and the like and vulcanizing it. Instead of a sponge, other elastic materials such as urethane foam having a restoring characteristic may be used.

Next, a description will be given of a relationship between an amount of clearance provided in the snap fittings 40 and an amount by which the sponges 43*a* and 43*b* are compressed. When the snap fittings 40 are in the engaged state, the sponges 43*a* and 43*b* are compressed by a predetermined amount. In this state, restoring force of the sponges 43*a* and 43*b* cause a reaction force to be applied to the fitting surfaces 41*a* and 41*b*. This means that, at the fitting part 45, the fitting surfaces 41*a* and 41*b* are apart from each other by a distance equal to the clearance provided in the snap fittings 40 when they compress the sponges 43*a* and 43*b* between them. Thus, in order to secure air-tightness of the fitting part 45, the sum of the thicknesses of the sponges 43*a* and 43*b* needs to be larger than the clearance provided in the snap fittings 40.

Also, if compression amount of the sponges 43*a* and 43*b* is too small, adaptability of the sponges 43*a* and 43*b* with respect to displacement of the fitting surfaces 41*a* and 41*b* is reduced, which increases the likelihood of a gap being formed between the housing 20 and the cover 21. On the other hand, if the compression amount is too large, the fitting part 45 may be deformed at parts thereof between adjacent snap fittings 40 due to the restoring force of the sponges 43*a* and 43*b*. In particular, in a case in which the toner sensor 27 is disposed on the cover housing 20 or the cover 21, deformation of the housing 20 or the cover 21 causes the toner sensor 27 to be displaced, which inconveniently causes a detection error.

To prevent this inconvenience, it is necessary to set the compression amount of the sponges 43*a* and 43*b* within an appropriate range according to the clearance provided in the snap fittings 40. Depending on the elasticity of sponge, an appropriate compression amount of the sponges 43*a* and 43*b* is about 70% of the initial thickness of the sponge. For example, in a case in which the clearance of the snap fittings 40 is 0.6 mm, the sponges 43*a* and 43*b* attached to the fitting surfaces 41*a* and 41*b* each should be 1 mm thick and compressed by 0.7 mm, that is, 1.4 mm in total.

It should be understood that the embodiments specifically described above are not meant to limit the present invention, and that many variations and modifications can be made within the spirit of the present invention. For example, the above described embodiments specifically deal with fitting of a cover and a housing of a development unit, but it goes without saying that the present invention is applicable likewise to a toner container or a toner cartridge that supply developer (toner) to a development unit.

Without being limited to the tandem-type color printer shown in FIG. 1, the present invention is applicable to various types of image forming apparatuses such as digital or analog monochrome copiers and printers, rotary-development type color printers and copiers, and facsimiles that are provided with a developer storage container such as a development unit (development device), a toner container, and a toner cartridge.

EXAMPLE

A research was conducted to test the developer leakage prevention effect of the developer storage container of the present invention. In the research, a development unit as shown in FIG. 3 in which clearance of 0.6 mm is provided in the snap fittings and that has 1 mm thick sponges attached to the fitting surfaces of the housing and the cover was used as an example of the present invention. On the other hand, a development unit having a 2 mm thick sponge attached to the fitting surface of the cover alone was used as a comparative example. The total compression amount of the sponges in the example of the present invention and the compression amount of the sponge in the comparative example were both 1.4 mm (70%).

The test method used in the research was as follows: a development unit of the present invention and a development unit of the comparative example were each packed in a cardboard case and each dropped from a height of 90 cm a total of eleven times; twice in such a manner that it landed on the bottom face; once in such a manner that it landed on a corner (one of the corners); three times in such a manner that it landed on an edge (once for each of the three edges along width, length, and height directions); once in such a manner that it landed on the top face; and four times in such a manner that it landed on a side surface (once for each of the four side surfaces). Thereafter, the development unit was taken out of the cardboard case, and checked with eyes for damage and developer leakage.

In the tests, no developer leakage was found to have occurred at the fitting part between the housing and the cover in the development unit of the present invention having sponges attached to both the housing side and the cover side. In contrast, noticeable developer leakage was found to have occurred at the fitting part in the development unit of the comparative example having a sponge attached to the cover side alone. As a result, it has been confirmed that, even though the compression amount of the sponges in the present invention and that of the sponge in the comparative example are the same, developer leakage can be prevented more effectively with the structure of the present invention having the sponges attached to both the housing side and the cover side than with the structure of the comparative example having the sponge attached to one side alone.

The present invention is applicable to developer storage containers such as development devices, toner containers, and toner cartridges. In the present invention, elastic members are attached one to each of the fitting surfaces of the first and second frame bodies all around them, and, in a state in which the first and second frame bodies are fitted together by fitting means, the elastic members are compressed by a predetermined amount. Examples of specific structures of the present invention include a structure in which, all around the fitting surfaces of the housing and the cover that are fitted together by snap fittings, there are attached sponges the sum of the thicknesses of whom is larger than the clearance provided in the snap fitting.

With this structure, in comparison with the conventional structure, adaptability of the elastic members with respect to displacement of the fitting surfaces is significantly improved, and this reduces the likelihood of a gap being formed between the first and second frame bodies when a shock is applied to the developer storage container. Thus, with this structure, there can be provided a developer storage container capable of effectively preventing developer leakage from occurring at the fitting part with a simple structure.

In addition, with the developer storage container of the present invention, it is possible to realize an image forming apparatus not only capable of preventing its inside part from being stained with developer leaked from a developer storage container, but also excellent in maintainability of the developer storage container.

What is claimed is:

1. A developer storage container, comprising:

a first frame body for storing a developer;

a second frame body that is fitted to the first frame body;

fitting means having a locking portion formed in one of the first and second frame bodies and a locking portion formed in an other of the first and second frame bodies; and a sponge that is attached to a fitting surface of each of the first and second frame bodies all around the fitting surface, and that is compressed by about 70% of an initial thickness of the sponge when the first and second frame bodies are in a fitting state in which the first and second frame bodies are fitted together by the fitting means.

2. The developer storage container of claim 1, wherein the fitting means is a snap fitting comprising a bridge formed in one of the first and second frame bodies and a projection formed in an other of the first and second frame bodies, at least one of the bridge and the projection being elastically deformed to achieve engagement between the bridge and the projection.

3. The developer storage container of claim 2, wherein the sponge is substantially rectangular in cross-section.

4. An image forming apparatus, comprising:
the developer storage container of claim 1.

5. An image forming apparatus, comprising:
the developer storage container of claim 2.

6. An image forming apparatus, comprising:
the developer storage container of claim 3.

* * * * *